United States Patent [19]

Kimura

[11] 4,014,544

[45] Mar. 29, 1977

[54] ELECTRIFIED AMUSEMENT DEVICE

[76] Inventor: Torazo Kimura, 1-8-10, Wakabayashi, Setagaya, Tokyo, Japan

[22] Filed: Mar. 8, 1976

[21] Appl. No.: 664,827

Related U.S. Application Data

[63] Continuation-in-part of Ser. No. 581,908, May 29, 1975, abandoned.

[52] U.S. Cl. ..... 273/85 R; 273/1 E; 273/1 M

[51] Int. Cl.[2] ..... A63F 9/00

[58] Field of Search ..... 273/85 R, 1 E, 1 M

[56] References Cited

UNITED STATES PATENTS

| | | | |
|---|---|---|---|
| 3,266,802 | 8/1966 | Balanyi | 273/1 M |
| 3,337,218 | 8/1967 | Hurley | 273/85 R |
| 3,529,821 | 9/1970 | Piazza | 273/1 E |
| 3,583,538 | 6/1971 | Hurley | 273/85 R X |
| 3,712,617 | 1/1973 | Ohlschlager | 273/1 M X |
| 3,778,058 | 12/1973 | Rausch | 273/85 R |
| 3,831,172 | 8/1974 | Olliges | 273/1 E X |

*Primary Examiner*—Paul E. Shapiro

[57] ABSTRACT

An amusement device for competitive playing of a simulated sport, such as table tennis, in which the successful performance of an act which forms part of the sport, for example the striking of a ball with a paddle, is simulated by the magnetic actuation of a switch (which may produce itself an acoustical simulation of the sound of hitting a ball or may do so through electrical circuits including a loudspeaker) when each member in the device representing one of the paddles is brought, by control manipulaton (remote, if desired) performed by a player, to the proper position with respect to the device member representing the ball so as to effect such magnetic switch actuation, such switch, in turn, being capable of controlling one or more counting members in the device.

10 Claims, 5 Drawing Figures

ELECTRIFIED AMUSEMENT DEVICE

RELEVANT COPENDING APPLICATION

This application is a continuation-in-part of U.S. patent application Ser. No. 581,908 filed May 29, 1975 entitled ELECTRIFIED AMUSEMENT DEVICE invented by the same inventor as the invention herein described and claimed, and now abandoned. The only matter which can be found in this application and not in the earlier application is that related to FIG. 5, herein. As to the subject matter of FIG. 5, which is a circuit for lighting a lamp when a player misses the simulated table tennis ball, the priority date of the Japanese patent application referred to in the Declaration filed herewith, namely Nov. 27, 1974, is not claimed since that application did not disclose the "missed-ball lamp" concept disclosed and claimed herein.

BACKGROUND OF THE INVENTION

1. Field of the Invention

This invention relates to amusement devices and more specifically to electrified simulators of competitive sports.

2. Description of the Prior Art

Various amusement devices in which the playing of a game, such as table tennis, is simulated have been described in the patent literature. Some of these devices are electromechanical and some are all-electronic. In general, the electronic devices are quite complex and expensive. They also are difficult to maintain. The electromechanical devices of the prior art measure timing skills of a player but not positioning skills. For example, they require for a proper "hit" by a player the pushing of a button at the same time as a stepping switch is in a particular step in its sequence. Thus, the electronic devices, while capable of testing positioning and timing skills of a player are too expensive and complex for widespread use. The electromechanical devices, while less complex and expensive than the electronic devices, are limited in their challenge to the players.

Accordingly, it is an object of the present invention to provide an amusement device which overcomes the foregoing disadvantages.

It is a further object of this invention to provide an amusement device which is low in cost of manufacture and maintenance and high in its level of skill testing for the players.

SUMMARY OF THE INVENTION

In brief, a motor driven mechanism resembling a miniaturized gantry crane carries an electric light (representing a ball in play) and a pair of magnets on a central carriage which corresponds to the cab on a gantry crane and moves in two dimensions as the mechanism is driven. At each of the opposite extremities of movement of the gantry is a linearly movable carriage bearing a paddle light corresponding to a player's paddle. The position of the movable member along its linear track is controlled by a player through the operation of a wire-linked or radio-linked control box operated by each player. Operation of the control box by a player can produce bi-directional motion of the lamp and carriage representing each paddle. Each paddle-lamp carriage also carries a magnetically actuable switch. Each such switch, when it closes, produces the simulated sound of a paddle hitting a ball. Such sound is produced either by the actual closing sound of the switch or by use of an electrical circuit which is closed as the switch closes, that circuit including a loudspeaker and electronic circuits for amplification of the sound, if desired.

The ball lamp carriage carries a pair of magnets one on each side of the lamp and facing its associated paddle lamp mechanism.

When a player adjusts his control properly, the ball lamp carriage and a respective one of the paddle lamp carriages come in proximity to each other during the course of travel of the ball lamp carriage. One of the magnets on the ball lamp carriage causes the switch on the respective one of the paddle lamp carriages to be closed, producing the ball-hitting sound as described hereinbefore. Movement of the paddle lamp carriages along their guides to positions corresponding to the position of a player's controller on his control box is produced by a motor, which may be a servo motor, associated with each paddle carriage drive mechanism. The player controls may be radio-linked or wire-linked to the amusement device. The movement of the ball-lamp carriage and either of the paddle-lamp carriages appears as a moving spot of light on a translucent screen in the amusement device. A digital counter may be connected to each of the paddle lamp carriage switches to record the respective number of "hits" of each player.

BRIEF DESCRIPTION OF THE DRAWINGS

A better understanding of the present invention may be had from a consideration of the following detailed description, taken in conjunction with the accompanying drawing, in which.

DESCRIPTION OF THE PREFERRED EMBODIMENT

Figures 1, 2, 3, 4:
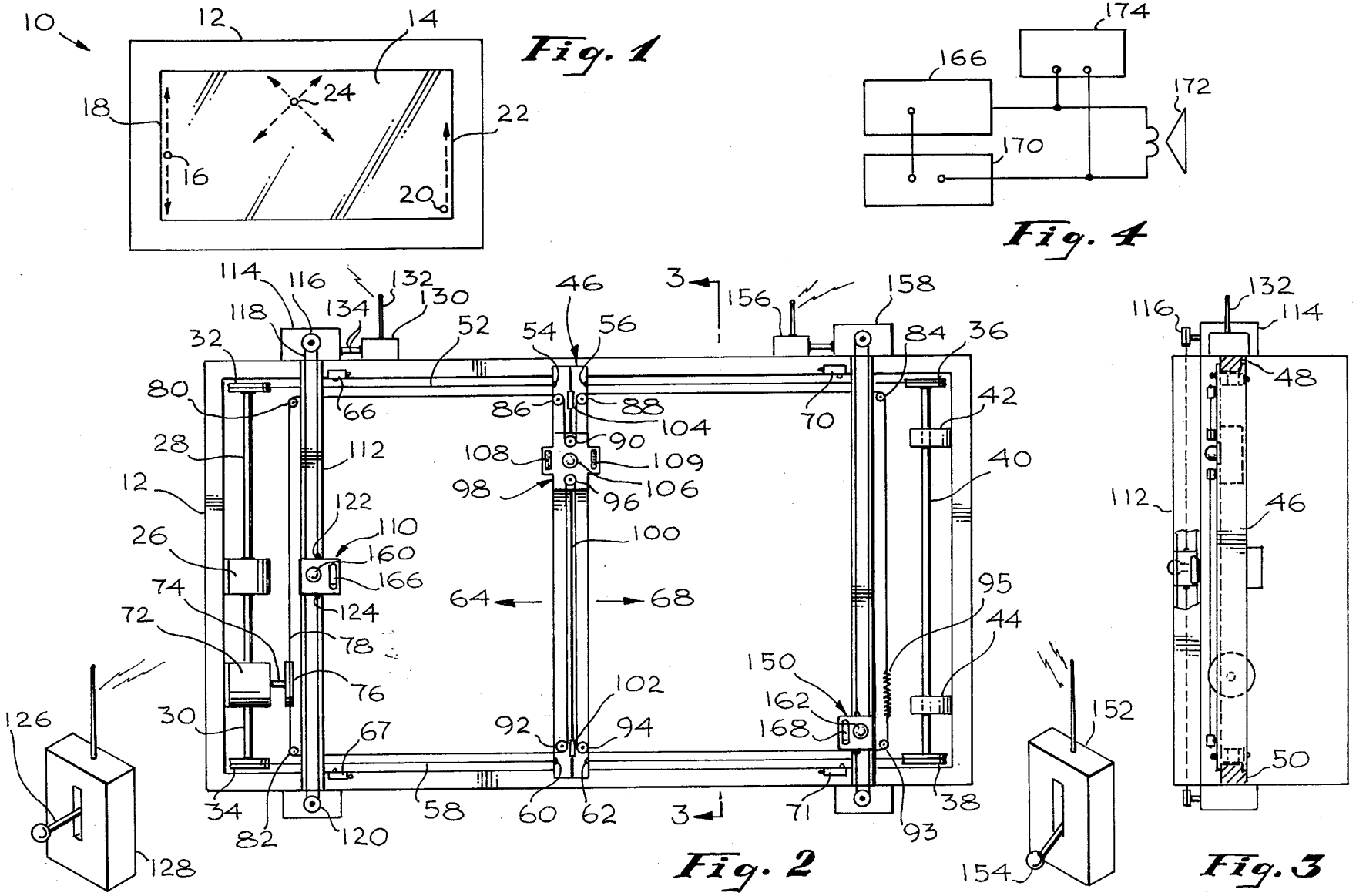
FIG. 1 is an elevation view of the amusement device according to this invention with the display screen in position for operation.
FIG. 2 is an elevation view, partially in diagrammatical form, of the device of FIG. 1, with the translucent display screen removed.
FIG. 3 is a sectional view taken along the line 3—3 in FIG. 2.
FIG. 4 is a schematic diagram, partially in block form, showing a "hit" sounding and scoring circuit for use in this invention; and, FIG. 5 is a schematic diagram of a circuit for lighting a "missed-ball" lamp when a player misses the simulated ball.

In FIG. 1, amusement device 10 includes frame 12 which has supported vertically therein translucent screen 14, such screen being of plastic or glass. Light spot 16, which represents the paddle of one of the players using amusement device 10, is movable up and down along edge 18 of screen 14 by a mechanism set forth more clearly in FIG. 2.

Light spot 20 represents the paddle of the other of the players using device 10. It moves along edge 22 of screen 14 under the control of the other player, the mechanism for achieving that motion and control being set forth more clearly in connection with the description of FIGS. 2, 3, and 4.

Light spot 24 represents the ball in play and it moves from edge 18 to edge 22 and back in a continuous sequence produced by the mechanism set forth in FIGS. 2 and 3 and described in connection with the description of those figures.

In FIG. 2, reversible motor 26 is coupled through shafts 28 and 30 to pulleys 32 and 34, respectively. Motor 26 may be supported, fixedly, from frame 12, as shown. Pulleys 36 and 38 are supported on shaft 40 which is rotatably supported in bearing blocks 42 and 44. Gantry member 46 is slidably supported on rails 48 and 50, which are seen more clearly in FIG. 3.

Drive string or cable 52 is connected at one end to point 54 on one side of gantry 46, passes over pulley 32, over pulley 36 and terminates at point 56 on the opposite side of gantry 46 from point 54.

Drive string or cable 58 is connected, at one end, to point 60 on one side of the remaining end of gantry 46, passes over pulleys 34 and 38, and terminates at point 62 on the opposite side of gantry 46 from point 60.

Operation of motor 26 in one direction of rotation causes gantry 46 to move in direction 64 in FIG. 2. This motion will continue until gantry 46 hits limit switch 66, at which point the direction of current flow to motor 26 will be reversed causing motor 26 to reverse the direction of motion of shafts 28 and 30 and, consequently, driven pulleys 32 and 34. This change in direction will be transmitted through strings or cables 52 and 58 and pulleys 36 and 38 to gantry 46, causing it to move in direction 68 until it hits limit switch 70, at which time the direction of rotation of the shaft of motor 26 and shafts 28 and 30 will again be reversed causing, ultimately, gantry 46 to move in direction 64 in FIG. 2 until it, once again, strikes limit switch 66 and the process is repeated. This oscillatory motion of gantry 46 continues for so long as device 10 is operated.

The circuits for reversing the direction of rotation of the shaft of motor 26 are well known and need not be shown here. In its simplest form, motor 26 is a d.c. motor and reversal of direction is effected by reversing the polarity of the potential applied thereto. Limit switch 66 can be used to actuate a stepping switch which, in successive steps, reverses the polarity of the output potential therefrom and, thus, reverses the direction of motion of motor 26. The details of this circuit are well known in the art and need not be explained further here.

Motor 72, which is reversible in the direction of motion of its shaft 74, drives pulley 76. Drive string or cable 78 passes around pulley 76 so as to be driven thereby and, in addition, passes over idler pulleys 80, 82, 93 and 84, supported from frame 12, and over pulleys 86, 88, 92 and 94 which are supported from gantry 46, and terminates, at one end, in tensioning spring 95. In addition, string or cable 78 passes over pulleys 90 and 96 which are mounted on ball-lamp carriage 98. Ball-lamp carriage 98 is mounted for movement in guide track 100 of gantry 46. When drive pulley 76 is rotated in a clockwise direction by motor 72, string or cable 78 pulls ball-lamp carriage 98 in a downward direction until carriage 98 strikes limit switch 102 which is so connected in the electrical circuit to motor 72 as to reverse the direction of rotation of shaft 74 and pulley 76. Such reversal pulls string or cable 78 in such a direction that carriage 98 moves upwardly until it strikes limit switch 104, at which point the direction of rotation of shaft 74 once more reverses and carriage 98 moves downward. The resultant of the vertical oscillatory motion of carriage 98 and the horizontal oscillatory motion of gantry 46 is the tracing of a series of diagonal light paths on translucent screen 22 (FIG. 1) by ball lamp 106.

In addition to carrying ball lamp 106 (the power for the operation of which is provided from an a.c. or d.c. source, not shown), carriage 98 carries two permanent magnets, 108 and 109, which may be of the ceramic type, on opposite sides of ball lamp 106, as shown.

Paddle lamp carriage 110 is carried in movable fashion on rail 112 (seen more clearly in FIG. 3). Motor 114, through drive pulley 116, drives string or cable 118, which passes over idler pulley 120 and is connected at its opposite ends to opposite sides 122 and 124 of carriage 110. Operation of motor 114 in one direction moves paddle lamp carriage upwardly until is strikes limit switch 66, at which time the current flow to motor 114 is interrupted momentarily, utilizing well-known delayed action devices such as a relay which opens its contacts rapidly on the closure of switch 66 breaking the circuit to motor 114, and delays the closure of its contacts for a predetermined time, permitting the player to re-position his paddle control lever 126 more centrally in remote control 128 before current is re-applied to motor 114 by the relay, not shown. Similar action is produced when carriage 110 hits lower limit switch 67.

Because of the servo characteristics of motor 114, the paddle lamp carriage 110 will be caused to follow the re-positioning of lever 126. If lever 126 is not re-positioned at the time the circuit to motor 114 is closed by the time-delay relay, not shown, and, as a result, carriage 110 is still actuating limit switch 66, the relay will be re-energized for another period and the motor 114 will be de-energized for that period. This cycling action will continue until the player has positioned lever 126 more centrally. Such cycling will minimize component damage in the electromechanical system driving carriage 110.

Remote control 128 is shown as being radio-linked to paddle-lamp carriage 110. The receiver for the radio signal from control 128 is designated by the numeral 130 in FIG. 2. It includes antenna 132 for picking up the signals transmitted by control 128 and output leads 134 for conducting motor control information to motor 114.

Control of motor 114 may be by means of analog or digital signals transmitted by control 128 in response to the positioning of lever 126.

If control 128 is wire-linked to motor 114 well-known synchro techniques may be used to produce motion of carriage 110 when lever 126 is moved. Lever 126 can be connected to the shaft of the synchro transmitter to cause rotation of that shaft when lever 126 is moved. The shaft of synchro resolver motor 114 will follow the rotation of the shaft of the synchro transmitter motor in remote control 128. Thus the position of paddle lamp carriage 110 will correspond to the position of lever 126 in control 128. The theory and circuits for the operation of this synchro system are described in detail in such books as SERVOMECHANISM FUNDAMENTALS by Ben Zeines, published by McGraw-Hill Book Co., Inc., Library of Congress Catalog No. 58-59681, at pp. 49, et seq.

The circuits in control 128 and in receiver 114 for accomplishing remote control in the radio-linked case are well known. For one example of a radio control system applicable to this invention see the book REMOTE CONTROL BY RADIO authored by Bruinsma and published by Philips Gloeilampen Fabriken in 1952, page 8, et seq. There, several proportional control systems are described which are applicable to this invention.

The analysis of the electromechanical system which moves carriage 110 applies with equal validity to the system which moves carriage 150. Control of the position of that paddle lamp carrage is effected by remote control 152 through the adjustment of lever 154 by a player. If remote control 152 is radio-linked to amusement device 10, receiver 156 is provided to supply a control signal to motor 158 whereby the shaft of motor 158 is causes to rotate until carriage 150 is in a position corresponding to the position of lever 154 in control 152.

Control 152 may be wire-linked to motor 158 in the same fashion as was described in connection with control 128 and its associated servo motor 114.

Paddle positioning indicator lamps 160 and 162 produce light spots 16 and 20 on screen 22 in FIG. 1, those spots moving with carriages 110 and 150, respectively.

As has been described, ball carriage 98 traces a series of diagonal paths as it oscillates along both vertical and horizontal axes (as seen in FIG. 1). At one limit of its excursion it is in proximity to rail 112 which carries paddle-lamp carriage 110. If the position of carriage 110 has been properly selected by the player operating control 128 so as to bring carriage 110 proximate to the path of carriage 98, permanent magnet 108 will cause operation of magnetic switch 166 during the time when magnet 108 and switch 166 are proximate to each other. Switch 166 may be of the reed variety and, upon its closure, current may, as shown in FIG. 4, be permitted to flow from power supply 170 to electroacoustical transducer 172, which may be a simple loudspeaker or annunciator. On the closure of switch 166 a sound will be produced which will resemble that which is made when a paddle hits a ball. The same closure of switch 166 may be used to provide a pulse to counter 174 for counting the score in the game.

Similarly, when ball-lamp carriage 98 is proximate to paddle lamp carriage 150, at the other extreme of travel of gantry 46, permanent magnet 109 will actuate switch 168, which may be in a circuit identical with that shown in FIG. 4, and the sound corresponding to the hitting of a ball will again be heard. The same transducer 172 may be used to produce the sound of a hit by either player. Further, a counter (which may be identical with counter 174) representing the player operating control 152 will record a hit. Switch 168 may, again, be a reed switch.

While magnetically actuable switches 166 and 168 have been described as reed switches they may also be Hall-effect semiconductor devices which are sensitive to magnetic fields to effect circuit switching and, if desired, amplification of current. The circuits associated with such Hall-effect devices may be found in any recent semiconductor circuit design handbook and need not be described here.

Figure 5:
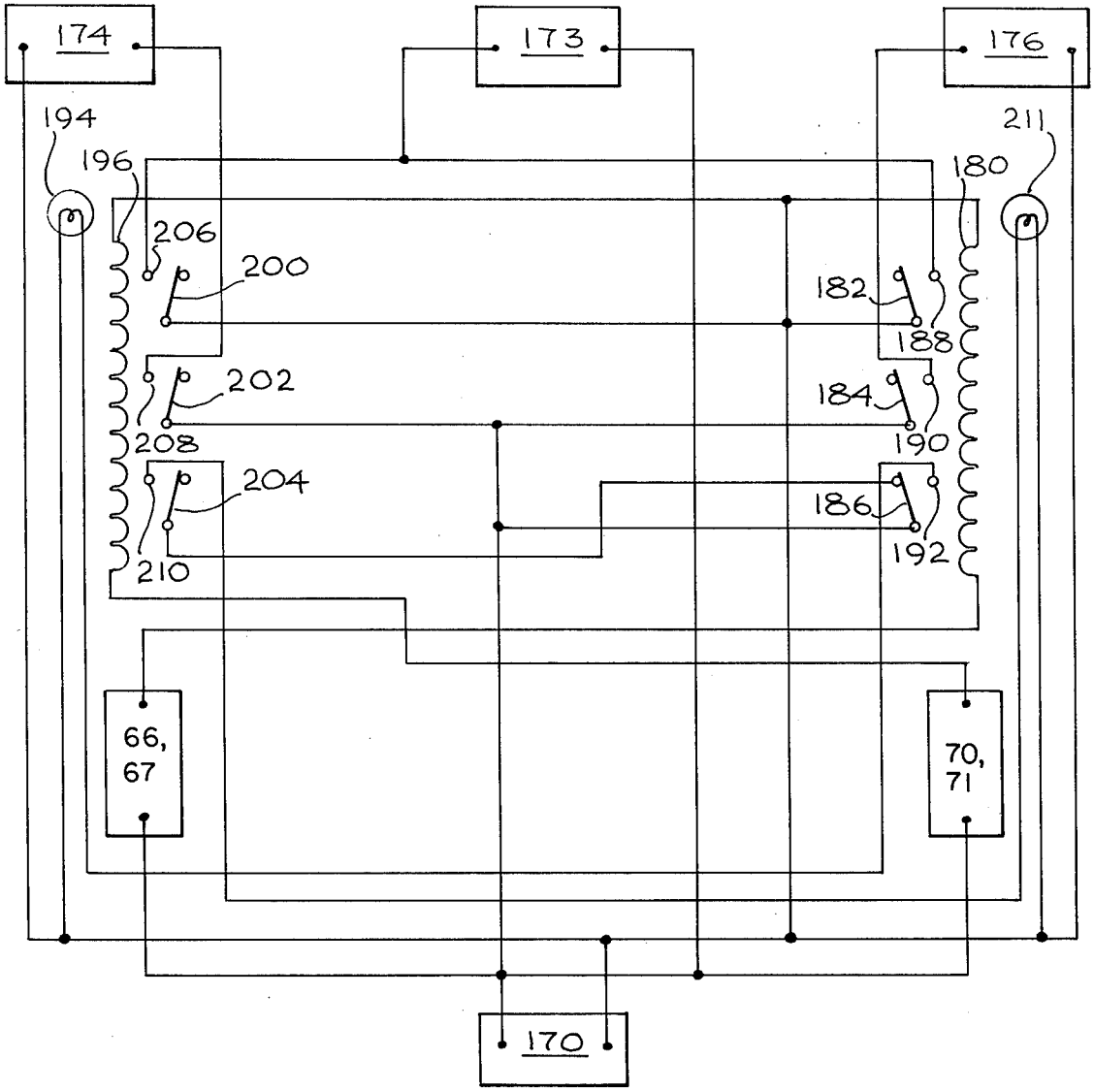

In FIG. 5 components similar to components in other figures are given corresponding numbers. As described in connection with FIG. 2, if paddle lamp carriage 110 does not pass proximate to ball-lamp carriage 98 when gantry 46 makes its excursion in direction 64, gantry 46 continues to move in direction 64 until it strikes limit switches 66 and 67 (which are wired in parallel for this lateral-motion limiting function) at which time the circuit from power supply 170 through relay solenoid 180 is closed, moving contact arms 182, 184 and 186 from the "open" position shown in FIG. 5 to "closed" positions in which arm 182 makes electrical contact with terminal 188, arm 184 makes electrical contact with terminal 190 and arm 186 makes electrical contact with terminal 192. When arm 182 strikes terminal 188 the electrical circuit from power supply 170 to sounder 173 is closed and a sound differing from the "hit ball" sound, for example a buzzer is heard indicating in this case, the ball being missed. When arm 184 strikes terminal 190, counter 176 is advanced one step. When arm 186 strikes terminal 192, the electrical circuit from power supply 170 through lamp 194 is closed lighting that lamp to show that the player controlling the left "paddle," that is paddle-lamp carriage 110, has missed the ball.

Similarly, limit switches 70 and 71 are in parallel for the purposes of controlling the lateral excursions of gantry 46 on the right side of the "table" as presented in FIG. 2.

When gantry 46 closes, either of these switches, solenoid 196 receives power from supply 170 and contact arms 200, 202 and 204 are moved from the open position displayed in FIG. 5 to a closed position in which arm 200 is in electrical contact with terminal 206, arm 202 is in electrical contact with terminal 208 and arm 204 is in electrical contact with terminal 210. When this state of relay arm positioning occurs, sounder 173 receives a surge of electrical current causing a sound indicating a missed ball. By simple circuit modifications this sound can be eliminated and only the hit ball sound which results when switch 166 or 168 is closed will remain. Simultaneously with the energization of solenoid 196 and the closing of contact pairs 202, 208 and 204, 210, respectively, counter 174 is advanced one step and missed-ball lamp 211 is energized.

The reversal of rotational direction of motor 26 is effected as described in connection with FIG. 2 whenever gantry 46 strikes limit switches 66, 67 or 70, 71, respectively, as a result of a "missed" ball.

While a particular embodiment of the present invention has been shown and described it should be understood that this invention is not limited to that embodiment and that all devices which fall within the scope of the claims which follow hereinafter are intended to be included within the scope of this invention.

What is claimed is:

1. An electrified amusement device including:

a frame, said frame having first and second extremities;

ball-lamp carriage driving means;

a ball-lamp carriage mounted in said frame and coupled to said driving means for movement along a resultant path made up of simultaneous oscillatory motions of said carriage along first and second mutually perpendicular paths throughout the period of operation of said amusement device, said ball-lamp carriage having a centrally mounted ball lamp and first and second magnets supported on said ball-lamp carriage on opposite sides of said ball lamp towards said first and second extremities of said frame;

a first rail mounted in said frame proximate to said first extremity thereof;

a first paddle-lamp carriage slidably supported on said first rail, said first paddle-lamp carriage having mounted thereon a first paddle lamp and a first magnetically actuable switch;

a second rail mounted in said frame proximate to said second extremity thereof;

a second paddle-lamp carriage slidably supported on said second rail, said second paddle-lamp carriage having mounted thereon a second paddle lamp and a second magnetically actuable switch;

first and second player controls for generating first and second paddle-lamp-carriage-positioning control signals, respectively;

a first paddle-lamp-carriage drive motor assembly mechanically coupled to said first paddle-lamp carriage and coupled to be responsive to said control signals from said first player control to position said first paddle-lamp carriage along said first rail;

a second paddle-lamp-carriage drive motor assembly mechanically coupled to said second paddle-lamp carriage and coupled to be responsive to said control signals from said second player control to position said second paddle-lamp carriage along said second rail;

said ball-lamp carriage having portions of said resultant path of motion proximate to said first and second rails;

a first electrical circuit including said first magnetically actuable switch;

said first magnetically actuable switch being responsive to said first magnet when said ball-lamp carriage is moving along one of said portions of said resultant path and said first paddle-lamp carriage is positioned adjacent said portion, to close said first electrical circuit;

a second electrical circuit including said second magnetically actuable switch;

said second magnetically actuable switch being responsive to said second magnet when said ball-lamp carriage is moving along one of said portions of said resultant path and said second paddle-lamp carriage is positioned adjacent said portion, to close said second electrical circuit; and sounding means responsive to the closure of said first or said second electrical circuits to produce a sound representing the hitting of a ball by a paddle.

2. Apparatus according to claim 1 in which said first player control is coupled to said first drive motor assembly by a radio link.

3. Apparatus according to claim 1 in which each of said first and second player controls is coupled to its respective drive motor assembly by a radio link.

4. Apparatus according to claim 1 which includes, in addition, first and second counter means coupled to said first and second magnetically actuable switches, respectively.

5. Apparatus according to claim 1 in which each of said player controls is connected to its respective drive motor assembly by a wire link.

6. Apparatus according to claim 1 which includes, in addition, a translucent screen supported in said frame adjacent said ball-lamp and paddle carriage assemblies.

7. Apparatus according to claim 1 in which said sounding means includes a loudspeaker.

8. Apparatus according to claim 7 which includes, in addition, first and second counter means coupled to said first and second magnetically actuable switches, respectively.

9. Apparatus according to claim 1 in which said sounding means includes first and second loudspeakers coupled to said first and second magnetically actuable switches, respectively.

10. Apparatus according to claim 1 including, in addition, a gantry supporting said ball lamp carriage and movable in said frame in oscillatory fashion towards said first and second rails;

first and second limit switches associated with said first and second rails respectively, for reversing the direction of said gantry upon physical contact between said gantry and said first and second limit switches, respectively;

first and second indicator-light circuits associated with said first and second rails, respectively, said first indicator-light circuit being responsive to physical contact between said gantry and said second limit switch to cause activation of an indicator light in said first indicator-light circuit, said second indicator-light circuit being responsive to physical contact between said gantry and said first limit switch to cause activation of an indicator light in said second indicator-light circuit.

* * * * *